US006442773B1

(12) United States Patent
Kopyar et al.

(10) Patent No.: US 6,442,773 B1
(45) Date of Patent: Sep. 3, 2002

(54) ABOVE GROUND POOL COVER

(76) Inventors: Jerry L. Kopyar, 501 Fulton St., Wheeling, WV (US) 26003; Dennis L. Cook, Sr., 501 Fulton St., Wheeling, WV (US) 26003; H. Andrew Cook, 501 Fulton St., Wheeling, WV (US) 26003

( * ) Notice: Subject to any disclaimer, the term of this patent is extended or adjusted under 35 U.S.C. 154(b) by 0 days.

(21) Appl. No.: 09/803,306

(22) Filed: Mar. 12, 2001

(51) Int. Cl.[7] ..... E04H 4/08
(52) U.S. Cl. ..... 4/498
(58) Field of Search ..... 4/498, 503; 135/124, 135/135, 136, 115

(56) References Cited

U.S. PATENT DOCUMENTS 3,534,412 A * 10/1970 Crook ..... 4/498
3,683,427 A * 8/1972 Burkholz et al. ..... 4/503
3,927,427 A 12/1975 Aine
4,122,562 A 10/1978 Sorrentino
4,136,408 A * 1/1979 Dahlbeck et al. ..... 4/498
4,257,132 A * 3/1981 Kerby ..... 4/498
4,951,327 A 8/1990 Del Gorio, Sr.
5,371,907 A 12/1994 Horvath
5,388,284 A 2/1995 Garnett
5,450,635 A * 9/1995 Coffey ..... 4/498
5,617,681 A * 4/1997 Lyons ..... 4/498
5,687,432 A * 11/1997 Genzel ..... 4/498
5,943,709 A * 8/1999 Chiu ..... 4/498

* cited by examiner

*Primary Examiner*—Charles R. Eloshway
(74) *Attorney, Agent, or Firm*—William P. Smith

(57) ABSTRACT

A pool cover support frame has a central vertical support member with a plurality of radially projecting spokes extending from a hub mounted atop the central vertical support member. The spokes attach to the edge of the pool walls via clamps, and are spaced evenly about the perimeter. Spokes are inserted under compressive force into the hub, causing them to bow outwardly in an arc, creating an arched dome over which to arrange a pool cover.

13 Claims, 4 Drawing Sheets

ABOVE GROUND POOL COVER

FIELD OF THE INVENTION

The field of this invention is swimming pool cover supports, and more particularly, an above ground swimming pool cover support frame.

BACKGROUND

Various pool covers are well known in the prior art. Support frames have been disclosed with support covers over swimming pools. The present invention is designed to prevent the cover from sagging which is a typical problem experienced with pool covers and frames. By the spring arching effect achieved by each individual spoke in a spoke and hub arrangement, a pool cover may be held taut over the frame so as to repel and redirect precipitation, leaves and other debris. This stretching property thus avoids festooning and sagging which in other arrangements causing pooling and collection pockets. These pockets allow accumulation of water, leaves and dirt under which the cover membrane ultimately stretches, pulls loose or gives way.

SUMMARY OF INVENTION

What is disclosed is a frame for supporting a swimming pool cover comprising a center support member having a base portion and a mast portion, with the mast portion extending vertically from said base portion to a height greater than the pool wall. A center hub portion has a connecting means to attach the hub portion to the top of the mast portion. Also, a plurality of first receiving means are provided, for receiving the radially extended support spokes. A plurality of side bracket portions each include means for engaging the top edge of the pool, and a second receiving means for receiving the other end of each radially extended support spoke. A plurality of support spokes each have a first end adapted for insertion into a respective first receiving means on the hub, and a second end adapted for insertion into a respective second receiving means in one of said plurality of said side brackets. Each of the support spokes may be inserted into the first receiving means and extended radially to a corresponding one of said side brackets, with a compressive force so as to deflect each said support spokes outwardly in an arch to form a dome like canopy over which a cover membrane may be supported.

It is an object of the present invention to provide a pool cover framework that is designed to prevent the typical sagging of the pool cover, thus adequately covering the pool and preventing any water or debris from entering the pool.

It is further an object of the present invention to provide pool tarp support spokes constructed of galvanized tubing, sidewall brackets constructed of galvanized sheet, a spoke hub constructed of galvanized tubing, a PVC main support tube, and spokes constructed of a plastic extrusion with stainless steel wingnuts.

Yet another object of the present invention to provide a base which rests on the bottom center of a swimming pool and attaches to the adjustable main support tube, with a spoke hub attached to the top of the support tube to accommodate the tarp support spokes.

It is also an object of the present invention to provide a support frame having a preformed bow shape designed to provide framework for the pool cover.

Another object of the present invention to provide sidewall brackets which include self-adhesive foam rubber on all contacting edges that attach around the edge of a swimming pool.

It is further an object of the present invention to provide a pool cover support frame that can be assembled from the side of the pool, without having to enter the pool

DETAILED DESCRIPTION OF THE INVENTION

Figure 1:
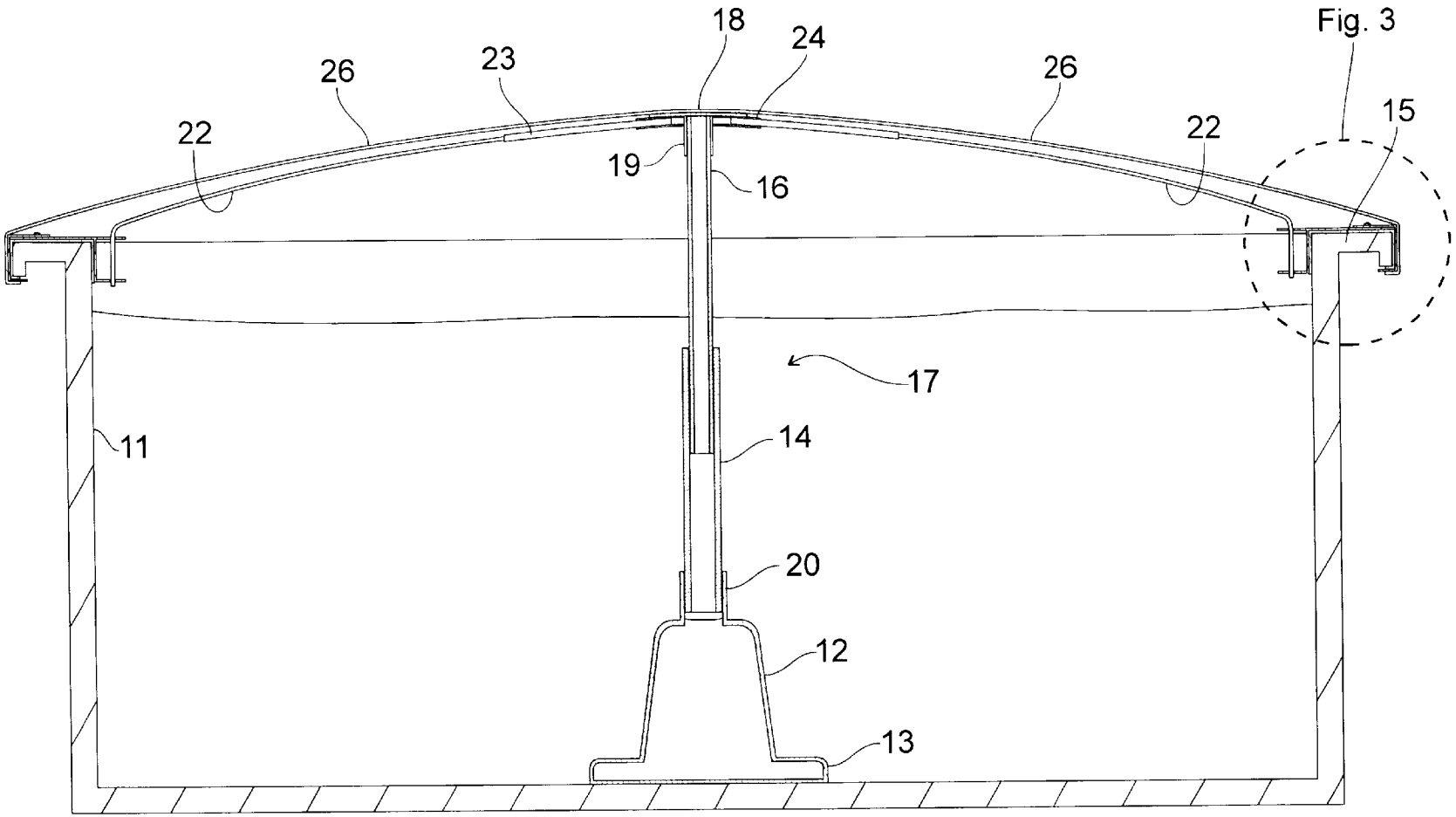
FIG. 1 is a cross-sectional elevational view of the device disposed in a swimming pool.

Referring to FIG. 1, a swimming pool cover support assembly is generally designated as 10. A center support assembly 17 is disposed within approximately the center of the swimming pool. A bell shaped base portion 12 has a stabilizer portion 13 which rests on the bottom of the pool. Socket portion 20 is adapted to receive tubular portion 14. Socket 20 is comprised of a hollow cylindrical stub extending upward from base portion 12. A telescoping tubular portion 16 is inserted within the hollow bore of tubular portion 14 and adjusted to a desirable height, which height would extend the top of tubular portion 16 to a height approximately 12 inches or greater above the pool side walls, so as to permit a domed canopy to be formed. Once the desirable height is determined, tubular portion is affixed with a pin, bolt, or adhesive, to tubular portion 14. In the preferred embodiment, the center support member 17 is comprised of PVC plastic tubing material. Tubing material must be of sufficient wall thickness to maintain a rigid vertical support or mast which maintains a substantially vertical posture for center support assembly 17. Base member 12 may be of PVC plastic or a water-resistant metallic material.

Figure 4:
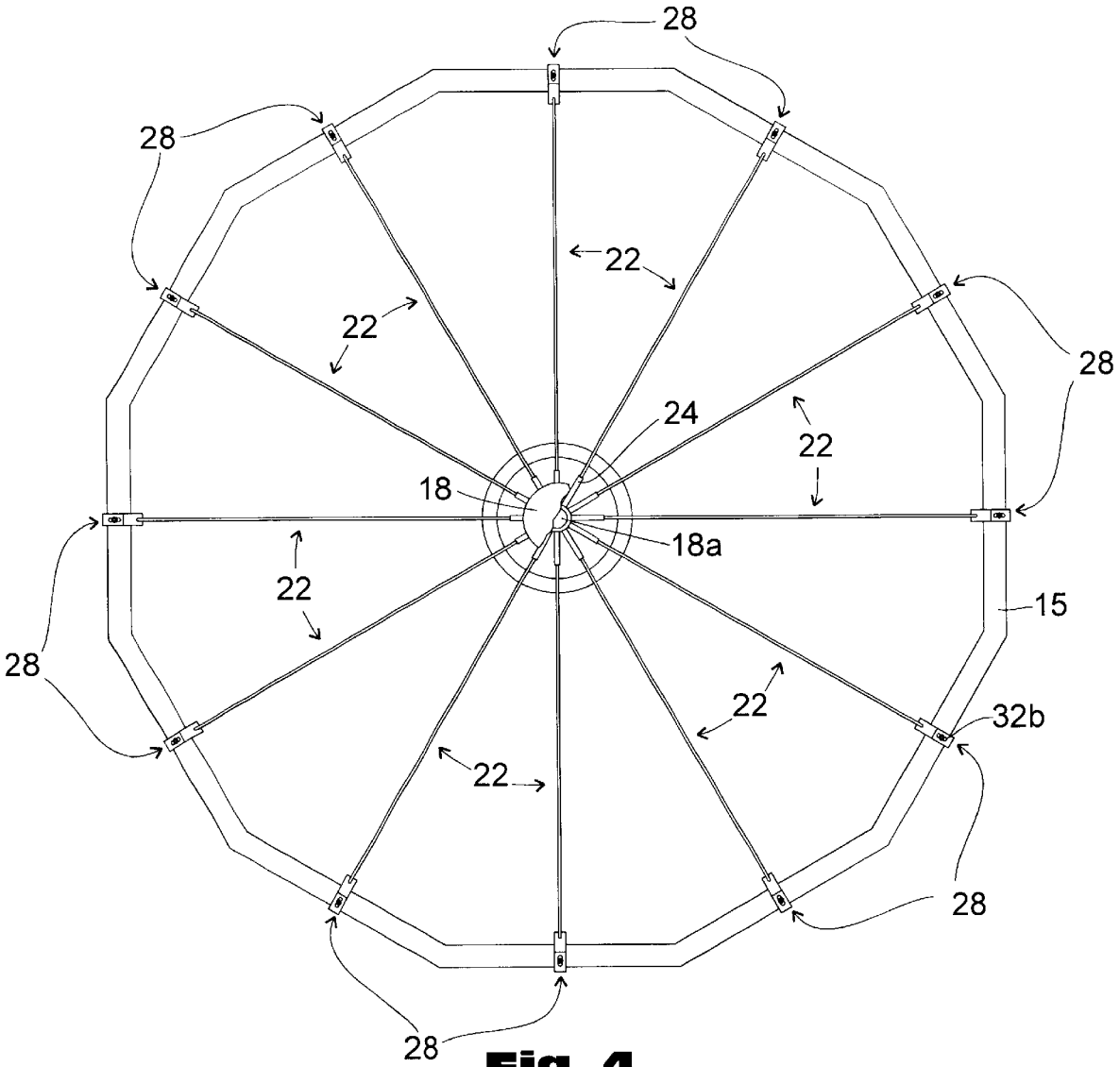
FIG. 4 is a plan view showing the hub and spoke arrangement of the spokes extending to the periphery of the swimming pool, and a partial fragmentary view of the center cap portion.

At the top of center support assembly 17 a cap portion 18 rests upon tube portion 16, maintained in place by socket portion 19. Socket portion 19 fits over tube portion 16 in a sleeve type slight friction fit and in the preferred embodiment is removable, although optionally one may choose to adhesively affix cap portion 18 to tube portion 16. Cap portion 18 has a plurality of sockets 24 extending radially from the center point of cap portion 18. Sockets 24 are adapted to accept spoke portions 23 extending radially outward to the pool flange 15. In a preferred embodiment, as illustrated in FIG. 4, twelve individual sockets 24 are provided, although more or less spoke portions 22 may be provided as needed. A pool cover 26 may then be fitted over the top of the dome. like canopy created by the plurality of spokes extending outward to pool flange 15.

Figure 2:
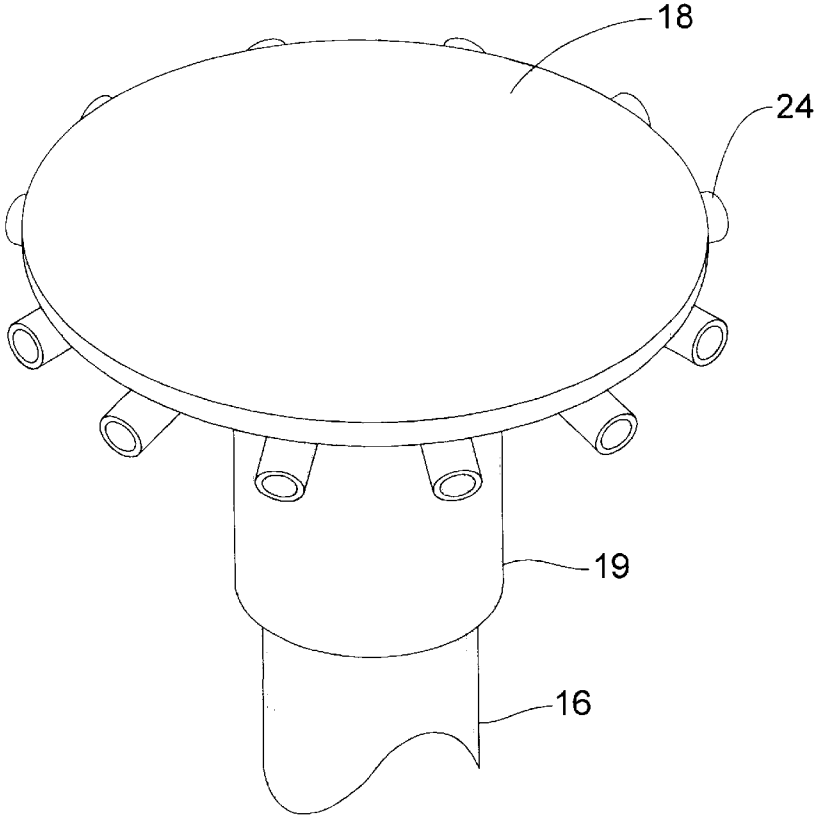
FIG. 2 is a fragmentary perspective view of the center hub sitting atop the central support element.

Referring now to FIG. 2, top cap 18 rests on center support tube 16, and is retained in place by socket 19 having a hollow cylindrical bore to accept tubular portion 16. A plurality of receiving means 24 are directed radially outward, towards the pool perimeter to accept spoke portions 23.

Figure 3:
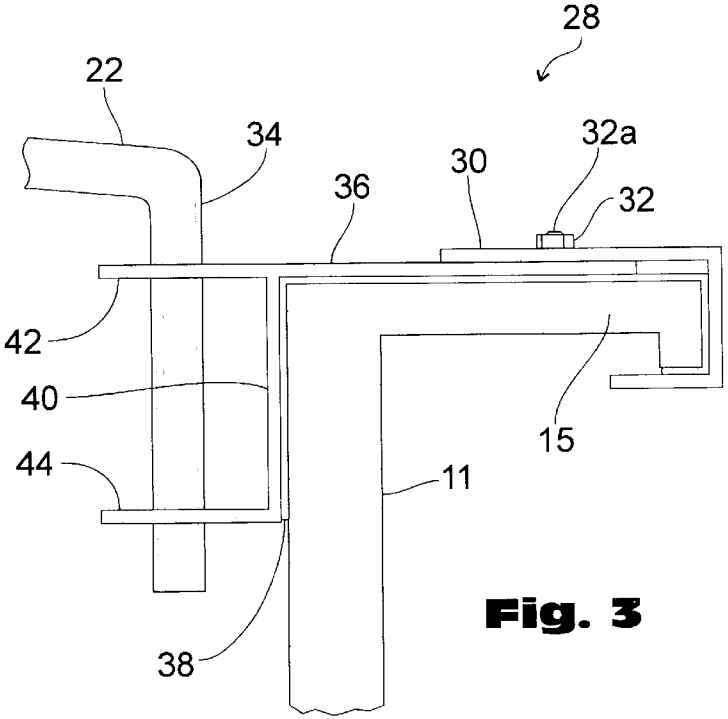
FIG. 3 is a sectional view of the bracket attaching an end of a spoke to the pool flange.

Referring now to FIG. 3, a detail illustrates the method of connection of spokes 22 to the pool flange 15. A flange bracket is generally designated as 28. A pair of horizontal plates 42, 44 are spaced apart and parallel to each other connected by vertical connector portion 40 adjacent the inside wall of pool 11. A hole (not shown) is drilled in each plate 42, 44 in vertical alignment to accept down leg 34, which extends vertically downward from spoke 22 at the termination end adjacent pool 11. Plate 42 extends horizontally into top plate 36 which rests on pool flange portion 11. A "J" shaped clamp 30 is fastened to parallel plate 36 by means of nut 32 which connects to threaded stud 32A projecting upward from horizontal plate 36. Connector stud 32A is spot welded or otherwise affixed to horizontal plate 36 and penetrates through "J" bracket 30 through a slotted opening 32B in "J" clamp bracket 30. A foam rubber protective strip 38 is inserted between bracket 28 and pool flange 15 in order to protect the parts of the pool in order to prevent direct contact from the bracket with parts of the pool. For example, a pool side wall typically has. a liner membrane which may be susceptible to piercing by contact with metal parts.

Referring next to FIG. 4, a top plan view illustrates the hub and spoke arrangement created by the spokes 22 inserted into sockets 24 connected to top cap 18. The angle (delta) formed between spoke portions 22 is preferably equal between all spoke portions. This creates a symmetry which allows for even distribution of the weight of the pool cover or tarp to be transferred to the pool side walls. Spoke portions 22 are inserted into sockets 24 and then clamped on pool flange 15 by means of the arrangement set forth in FIG. 3 for pool flange bracket 28. Top cap 18 is illustrated in a fragmentary portion to show the smooth top cap which covers hub 18A from which sockets 24 project radially outward. Top cap 18 provides a rounded, smooth protected cover of the dome canopy, to prevent contact between pool cover membrane 26 and various irregular metal parts underlying top cap 18. This additional precaution is intended to avoid tearing or snagging of the pool cover membrane 26 during installation.

Figure 5:
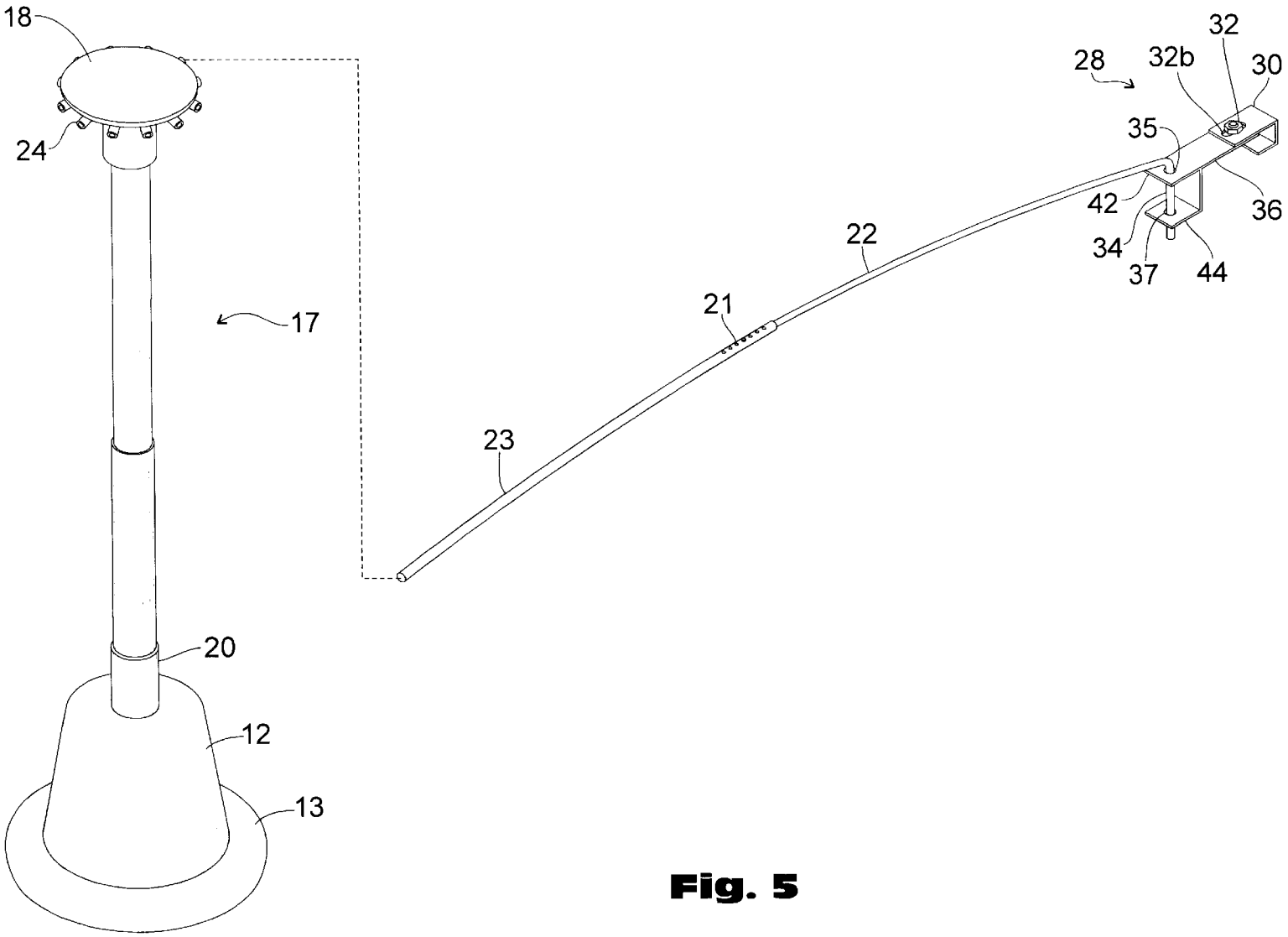
FIG. 5 is an exploded view showing a single spoke outside of the center support receiving member, and the free standing center support member.

Referring now to FIG. 5, the dotted line is intended to illustrate the point of insertion of spoke extension 23 into cap portion 18. Each socket 24 receives an individual spoke 22. Center support assembly 17 extends downward from top cap 18 to base portion 12 resting on the bottom of the swimming pool. An adjustment means 21 is provided at one end of spoke extension 23, where spoke 22 is inserted to spoke extension 23 and then adjusted to the desirable length which permits extension of spoke 22 into bracket 28 through holes 37, 35. Down leg 34 penetrates plates 42, 44 through holes 35, 37 to retain the position of spoke 22 in bracket 28. Also illustrated is adjustment slot 32B on "J" clamp 30. In a preferred embodiment, the angle between spoke 22 and down leg 34 will be slightly greater than a 90° angle, and the spoke sections 22, 23 when connected to sockets 24 and brackets 28 will be under compressive force causing a slight bulge or upward deflection of the thin rod, to effect a dome shape of the resulting canopy for the pool cover membrane 26 to be stretched over. Thus is created a framework which is designed to prevent a sagging of a pool cover while adequately covering the pool and preventing any water or debris from entering the pool. In the preferred embodiment, the tarp support spokes are constructed of galvanized steel tubing. The side wall brackets will be preferably constructed of a galvanized sheet metal and the spoke hub will be constructed of a galvanized plate with galvanized tubing. The main center of the support assembly as previously mentioned, will be constructed of a PVC plastic tubing, with sufficient wall thickness to maintain rigidity. The base cone 12 would be preferably constructed of a plastic extrusion having stainless steel wing nuts.

Further disclosed is a method for assembling a swimming pool cover support. First, the side wall brackets are attached to the swimming pool flange 15. Next, the assembled center support assembly is placed inside of the pool. Allow time for water to fill up the base portion 12. Insert a spoke 22 into a socket 24 at the 3:00 o'clock position, insert another spoke 22 into the socket 24 at the 9:00 o'clock position of cap portion 18. With two individuals positioned at the end of the spokes inserted at 3:00 o'clock and 9:00 o'clock, work the water filled base 12 toward the center of the swimming pool 11. Make sure two installed spokes 22 are positioned to accept side brackets 28. After these two spokes 22 are installed, complete the process by inserting the remaining support spokes 22 into spoke sockets 24 and connecting each said spokes 22 to the side wall brackets 28 onto pool flange 15. Using plastic clamps provided, fasten pool cover to the side of pool by clamping two at a time opposing each other until all have been installed. The entire pool cover support frame can be assembled from the side of the pool, without having to enter the pool.

According to the provisions of patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

We claim:

1. A frame for supporting a swimming pool cover comprising:

(A) a center support member having a base portion; a mast portion extending vertically from said base portion to a height greater than the pool walls;

(B) a center hub portion having connecting means to connect said hub portion to said mast portion, and a plurality of first receiving means;

(C) a plurality of side bracket portions, each of said side bracket portions including means for engaging the top edge of the pool, and a second receiving means;

(D) a plurality of support spokes, each of said spokes having a first end adapted for insertion into a respective first receiving means on said hub and a respective second receiving means in one of said plurality of said side brackets;

wherein said center hub also having a socket with a hollow cylindrical cavity, said cavity having slightly larger inside diameter than the outside diameter of said mast portion, such that the hub fits over the mast and is retained thereon by downward gravitational force due to weight associated with the spokes and center hub;

whereby each of said support spokes may be inserted into said first receiving means and extended radially to a corresponding one of said side brackets, each said spoke being flexible and of a length so as to create a compressive force when inserted into said second receiving means so as to deflect each said support spokes outwardly in an arch to form a dome like canopy over which a cover membrane may be supported.

2. The frame for supporting a swimming pool cover as set forth in claim 1, wherein said center support member also comprising a pair of telescoping tubular portions adapted to telescope to different lengths.

3. The frame for supporting a swimming pool cover as set forth in claim 1, wherein each of said side brackets includes securing means for removably securing said side brackets to the top edge of the pool.

4. The frame for supporting a swimming pool cover as set forth in claim 3, wherein each said second receiving means having at least one tab portion, each said tab portion having a hole drilled there through for insertion of one said spoke, for retentively positioning said second end adjacent to the pool top edge.

5. The frame for supporting a swimming pool cover as set forth in claim 3, wherein, each said second receiving means having a pair of tab portions, each of said tab portions having a hole there through, both said holes being vertically aligned to receive a second end portion of a respective spoke for retentively positioning said second end portion adjacent to the pool top edge.

6. The frame for supporting a swimming pool cover as set forth in claim 3, wherein said pool also having a flange portion projecting radially outward from the top edge, and said side brackets having means for connecting to said flange portion.

7. The frame for supporting a swimming pool cover as set forth in claim 6, wherein said connecting means also including an adjustment means for connecting said side bracket to flange portions of varying widths.

8. The frame for supporting a swimming pool cover as set forth in claim 6, wherein a self-adhesive foam rubber portion is adapted to be fastened to a pool flange portion and a portion of a side wall of the pool adjacent said side bracket to cushion and protect the pool liner and the pool top edge from direct contact with said plurality of side brackets.

9. The frame for supporting a swimming pool cover as set forth in claim 1, also comprising a cap portion wherein said cap portion also having a smooth top surface for shielding a pool cover membrane from the first receiving means.

10. The frame for supporting a swimming pool cover as set forth in claim 1, wherein said support spokes having adjustment means for varying the length of said support spokes between said center support member and the pool top edge.

11. A support frame for supporting a swimming pool cover comprising a first central support member having a bottom adapted to engage the bottom surface of the pool and a top, the difference from said bottom of said first central support member to said top thereof being greater than a distance from the bottom surface of the pool to the top of the side of the pool, said bottom of said central support member including means for adapting the orientation thereof to accommodate a pool having a sloped surface; a center joint, having engaging means to engage said top of said first central support member, and also having a plurality of first receiving means;

a plurality of side braces, each of said side braces including means for engaging the side of the pool, and a second receiving means; and a plurality of support arms each of said support arms having a first end adapted to engage a respective first receiving means in said center joint and a respective second receiving means in a respective one of said plurality of side braces; each of said support arms exerting a radial force when inserted into said first and second receiving means, thereby causing said support arm to bow upward in a convex arrangement, whereby said support arms may be deployed readily about said first central support member and may extend from said first central support member to a plurality of side braces disposed about the periphery of the pool so that a pool cover may be arranged thereon above the surface of the pool, said center joint engaging means including a socket in said center joint with a hollow cylindrical cavity, said cavity having slightly larger interior cross section than the exterior cross section of the central support member such that said center joint fits over the central support member and is retained thereon by downward gravitational force due to weight associated with the support arms and center joint.

12. A frame for supporting a swimming pool cover comprising:

(A) a center support member having a base portion; a mast portion extending vertically from said base portion to a height greater than the pool walls;

(B) a center hub portion having connecting means to connect said hub portion to said mast portion, and a plurality of first receiving means;

(C) a plurality of side bracket portions, each of said side bracket portion including means for engaging the top edge of the pool, and a second receiving means;

(D) a plurality of support spokes, each of said spokes having a first end adapted for insertion into a respective first receiving means on said hub and a respective second receiving means in one of said plurality of said side brackets;

whereby each of said support spokes may be inserted into said first receiving means and extended radially to a corresponding one of said side brackets, each said spoke being flexible and of a length so as to create a compressive force when inserted into said second receiving means so as to deflect each said support spokes outwardly in an arch to form a dome like canopy over which a cover membrane may be supported;

wherein each of said side brackets includes securing means for removably securing said side brackets to the top edge of the pool;

each said second receiving means having at least one tab portion, each said tab portion having a hole drilled there through for insertion of one said spoke, for retentively positioning said second end adjacent to the pool top edge.

13. A frame for supporting a swimming pool cover comprising:

(A) a center support member having a base portion; a mast portion extending vertically from said base portion to a height greater than the pool walls;

(B) a center hub portion having connecting means to connect said hub portion to said mast portion, and a plurality of first receiving means;

(C) a plurality of side bracket portions, each of said side bracket portion including means for engaging the top edge of the pool, and a second receiving means;

(D) a plurality of support spokes, each of said spokes having a first end adapted for insertion into a respective first receiving means on said hub and a respective second receiving means in one of said plurality of said side brackets;

whereby each of said support spokes may be inserted into said first receiving means and extended radially to a corresponding one of said side brackets, each said spoke being flexible and of a length so as to create a compressive force when inserted into said second receiving means so as to deflect each said support spokes outwardly in an arch to form a dome like canopy over which a cover membrane may be supported;

wherein each of said side brackets includes securing means for removably securing said side brackets to the top edge of the pool;

each said second receiving means having a pair of tab portions, each of said tab portions having a hole there through, both said holes being vertically aligned to receive a second end portion of a respective spoke for retentively positioning said second end portion adjacent to the pool top edge.

* * * * *